US005205098A

United States Patent [19]

Landis et al.

[11] Patent Number: 5,205,098

[45] Date of Patent: Apr. 27, 1993

[54] LONG-SPAN DECKING PANEL

[76] Inventors: Donald H. Landis, 308 Hermitage Dr.; David F. Landis, 50 Holland Rd., both of Pittsburgh, Pa. 15235

[21] Appl. No.: 897,264

[22] Filed: Jun. 11, 1992

[51] Int. Cl.[5] ..... E04B 1/20

[52] U.S. Cl. ..... 52/336; 52/785

[58] Field of Search ..... 52/785, 796, 674, 731, 52/732, 737, 299, 664, 669, 802, 810, 818, 820, 823, 336, 220, 221, 723, 728; 428/35.2, 23, 128

[56] References Cited

U.S. PATENT DOCUMENTS

| | | | |
|---|---|---|---|
| 2,031,631 | 2/1936 | Bemis | 52/220 |
| 3,312,034 | 4/1967 | Steinmann | 52/731 |
| 4,167,598 | 9/1979 | Logan et al. | 52/785 X |

*Primary Examiner*—David A. Scherbel
*Assistant Examiner*—Creighton Smith
*Attorney, Agent, or Firm*—Ansel M. Schwartz

[57] ABSTRACT

The present invention is a long-span decking panel. The decking panel is comprised of a first panel section having a first open channel. Extending from a first edge of the first open channel is a first side flange. Similarly, extending from a second edge of the first open channel is a second side flange. The first panel section has a first end for bearing against a first support surface and a second end for bearing against a second support surface. The support surfaces can be provided by structural I-beams or steel trusses, for example. The first panel section has a first length. The decking panel also comprises a second panel section having a second open channel. Extending from a first edge of the second open channel is a first side flange. Extending from the second edge of the second open channel is a second side flange. The first and second side flanges of the first panel section are fixedly connected to the first and second side flanges of the second panel section, respectively, such that the first and second open channels form a cell. The second panel section has a second length. The length of the second panel section is shorter than the length of the first panel section such that the second panel section preferably extends below the first and second support surfaces, when the first panel is supported thereupon. This is accomplished by assembling a first panel section 12 that is 4 to 24 inches longer than the second panel section 28.

21 Claims, 3 Drawing Sheets

LONG-SPAN DECKING PANEL

FIELD OF THE INVENTION

The present invention is related to decking panels. More specifically, the present invention is related to a decking panel capable of spanning extended lengths without requiring excessive clearance above the surface on which the decking panel bears upon.

BACKGROUND OF THE INVENTION

Previously known decking panels have been generally limited to depths of 7.5 to 8 inches and spanning lengths of 32 feet. In order to span lengths longer than 32 feet, precast concrete tee's are typically used. Unfortunately, precast concrete tees are more expensive and heavier per area of coverage than decking panels. Accordingly, there is a need for a decking panel capable of spanning lengths of over 32 feet. The present invention describes a decking panel which connects two panel sections to form a cell which provides a structurally strong panel to span distances over 32 feet. In order to maintain an acceptable clearance height above the support surface on which the panel is supported, the bottom panel section is shorter than the top panel such that it can extend below the support surface. In this manner, in the preferred embodiment, only the top panel section protrudes above the support surface. Since only the top panel protrudes over the structural support, the decking can be attached to the beam or truss without cutting a hole in the top panel.

In the past, two decking panel sections have been connected in a facing relationship, but their combined depth has been limited to 6 inches, thereby limiting their effective spanning length to 18 feet. These composite decking panels were essentially designed to provide closed cells for electrical wire distribution or hot and cold air distribution through the floor. These panels did not teach to have the bottom panel section shorter than the top panel section. Rather, both panel sections had the same length and the panel rested above the support structures in its entirety. With the bottom panel resting on the beam or truss to attach the panel to the structural support, a large hole would have to be cut in the top panel of each decking sheet to gain access to the bottom of the panel that was to be attached to the structure. The cutting of these holes was expensive and time consuming.

SUMMARY OF THE INVENTION

The present invention is a long-span decking panel. The decking panel is comprised of a first panel section having a first open channel. Extending from a first edge of the first open channel is a first side flange. Similarly, extending from a second edge of the first open channel is a second side flange. The first panel section has a first end for bearing against a first support surface and a second end for bearing against a second support surface. The support surfaces can be provided by structural I-beams or steel trusses, for example. The first panel section has a first length. The decking panel also comprises a second panel section having a second open channel. Extending from a first edge of the second open channel is a first side flange. Extending from the second edge of the second open channel is a second side flange. The first and second side flanges of the first panel section are fixedly connected to the first and second side flanges of the second panel section, respectively, such that the first and second open channels form a cell. The second panel section has a second length. The length of the second panel section is shorter than the length of the first panel section such that the second panel section preferably extends below the first and second support surfaces, when the first panel is supported thereupon. Since only the top panel protrudes over the structural support, the decking can be attached to the beam or truss without cutting a hole in the top panel.

Preferably, the combined depth of the first and second panel sections is at least 6 inches and can be as much as 20 inches. Thus, the long-span decking panel provides the depth necessary to span distances substantially over 32 feet, while extending above the support surfaces substantially less than its structural depth. Preferably, the first panel section length is at least 35 feet and can be as great as 60 feet. Though, there may be situations where designers, for instance, may like the appearance of this product for shorter spans than 35 feet, such as 20 feet.

The present invention is also a decking system. The decking system is comprised of at least two horizontally disposed structural elements, such as I-beams or steel trusses, which are spaced a predetermined distance apart. There is also at least one decking panel, having a cell, for spanning the distance between the structural elements. The decking panel has a depth of at least 6 inches but can be less. Preferably, the predetermined distance is at least 20 feet.

The present invention is also a method of forming a decking system comprising the steps of providing at least two horizontally disposed structural elements spaced at least 20 feet apart. Then, there is the step of disposing at least one decking panel between said structural elements such that each end of said decking panel is disposed upon at least one of said structural elements.

In a preferred embodiment, the first edges and the second edges of the decking panel are disposed at least 9 inches apart and the top flange members have an essentially flat unbroken soffit except for a series of stiffening ribs running transverse to the first and second edges which provide rigidity to the flange member along its length during operation.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
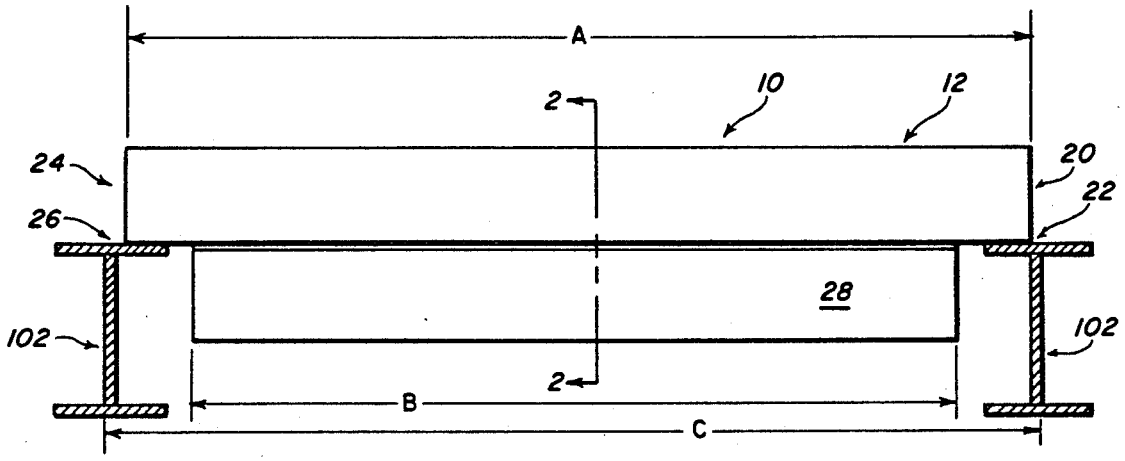
FIG. 1 is a schematic representation of a decking panel of the present invention.
Figure 2:
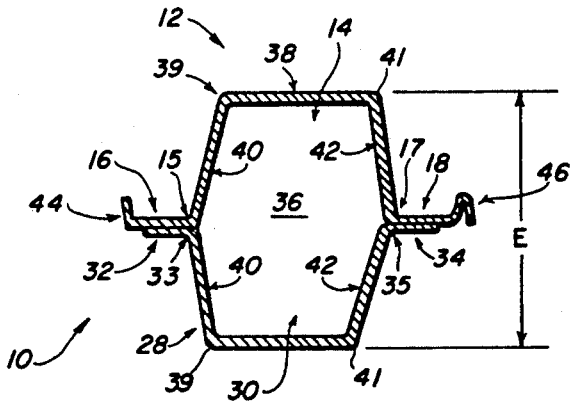
FIG. 2 is a schematic representation of the cross section 2—2 shown in FIG. 1.

Referring now to the drawings wherein like reference numerals refer to similar or identical parts throughout the several views, and more specifically to FIGS. 1 and 2 thereof, there is shown a long-span decking panel 10. The decking panel 10 is comprised of a first panel section 12 having a first open channel 14. Extending from a first edge 15 of the first open channel 14 is a first side flange 16. Similarly, extending from a second edge 17 of the first open channel 14 is a second side flange 18. The first panel section 12 has a first end 20 for bearing against a first support surface 22 and a second end 24 for bearing against a second support surface 26. The support surfaces 22, 26 can be provided by structural I-beams 102 or steel trusses, for example. The first panel section 12 has a first length, representing as reference character A is FIG. 1.

The decking panel 10 also comprises a second panel section 28 having a second open channel 30. Extending from a first edge 33 of the second open channel 30 is a first side flange 32. Extending from the second edge 35 of the second open channel 30 is a second side flange 34. The first and second side flanges 16, 18 of the first panel section 12 are fixedly connected to the first and second side flanges 32, 34 of the second panel section 28, respectively, such that the first and second open channels 14, 30 form a cell 36. The second panel section 28 has a second length represented as reference character B in FIG. 1. The length B of the second panel section 28 is shorter than the length A of the first panel section 12 such that the second panel section 28, preferably, extends below the first and second support surfaces 22, 26 when the first panel section 12 is supported thereupon. Preferably, the combined depth of the first and second panel sections 12, 28 is at least 6 inches and can be as much as 20 inches, as shown as reference character E in FIG. 2. Thus, the decking panel 10 provides the depth E necessary to span distances substantially over 32 feet because the greater the depth, the greater the structural strength of the panel 10, while extending above the support surfaces 22, 26 substantially less, than its structural depth E. Preferably, the first panel sections 12 length A is at least 20 feet and can be as great as 60 feet. The length A is at least 4 inches to 24 inches longer than length B, depending on the type of support surface. The second panel section 28 essentially acts as a stiffener which provides support to the first panel section 12.

In a preferred embodiment, each open channel 14, 30 is comprised of a top flange member 38 having a first edge 39 and a second edge 41 which extend the length of the top flange member 38. A first web member 40 is integrally joined with and extends obliquely from the first edge 39. A second web member 42 is integrally joined with and extends obliquely from the second edge 41. Preferably, the first and second web members 40 and 42 extend at an angle of approximately 87° with respect to the top flange 38. In order to join multiple decking panels 10 together, the first side flange 18 of the first panel section 12 can have a tab 44 which extends therefrom while the second side flange 16 can have a notch 46 for engaging with a tab 44 of an adjacently disposed decking panel (not shown).

Figure 4:
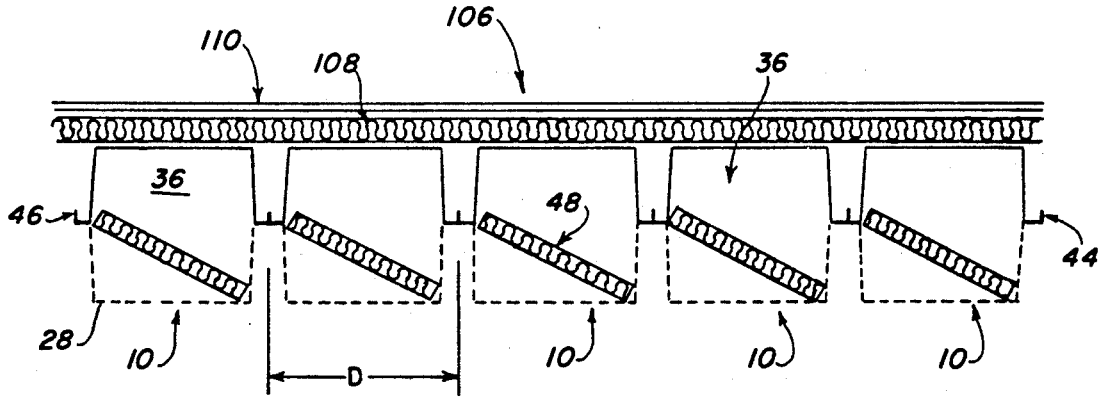
FIG. 4 is a schematic representation of the cross section 4—4 shown in FIG. 3.

In a preferred embodiment, each panel section 12, 28 is made of a galvanized steel sheet, 12 to 20 gage, which is bent to form the described geometry. As shown in FIG. 4, the second panel section 28 can have perforations, and a fiberglass bat 48 can be disposed within the cell 36 such that the decking panel 10 can act as an acoustical finished ceiling. The first and second side flanges 16, 18, 32, 34 can be connected in any convenient manner. For instance, they can be welded along their entire length or at spaced intervals. Alternatively, the side flanges 16, 18, 32, 34 can be connected with a plurality of fasteners such as screws or rivets (not shown).

Figure 3:
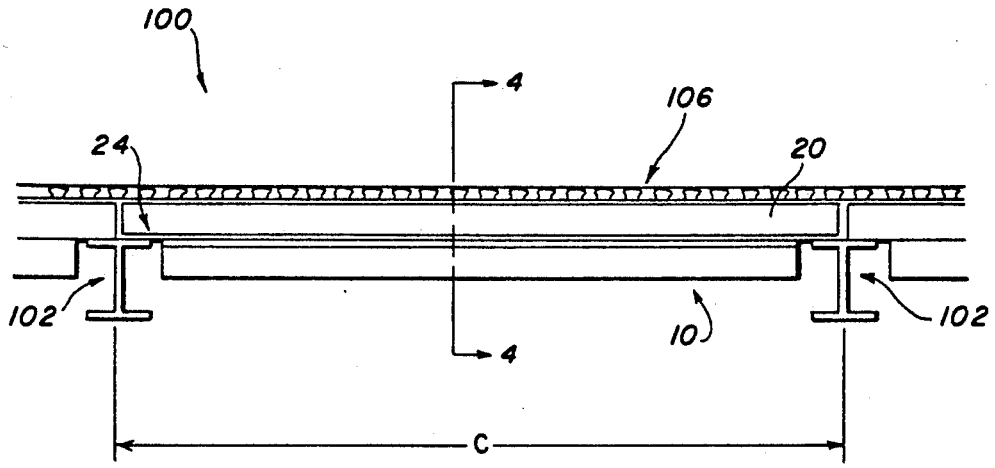
FIG. 3 is a schematic representation of a decking system of the present invention.

The present invention, as shown in FIGS. 3 and 4, is also a decking system 100. The decking system 100 is comprised of at least two horizontally disposed structural elements, such as I-beams 102 or steel trusses, which are spaced a predetermined distance apart. There is also at least one decking panel 10, having a cell 36, for spanning the distance between the structural elements 102. The decking panel 10 has a depth of at least 6 inches. Preferably, the predetermined distance, shown as reference character C, is at least 20 feet.

Each panel 10 preferably has a width of at least 12 inches as shown as reference character D in FIG. 4. A plurality of decking panels 104 are connected side-by-side to cover the entire space between the structural elements 102. In a preferred embodiment, the decking system 100 includes roofing material 106 which can include insulation 108 and an exposed roofing surface 110. Alternatively, the system can be used as a floor with concrete poured over the decking to form a structural floor.

The present invention is also a method of forming a decking system comprising the steps of providing at least two horizontally disposed structural elements, such as I-beams 102 or steel trusses, spaced at least 20 feet apart. Then, there is the step of disposing at least one decking panel between said structural elements such that each end of said decking panel is disposed upon at least one of said structural elements. Preferably, after the disposing step, there is the step of placing roofing material upon the decking panel, or concrete for the floor system.

Figures 5, 6:
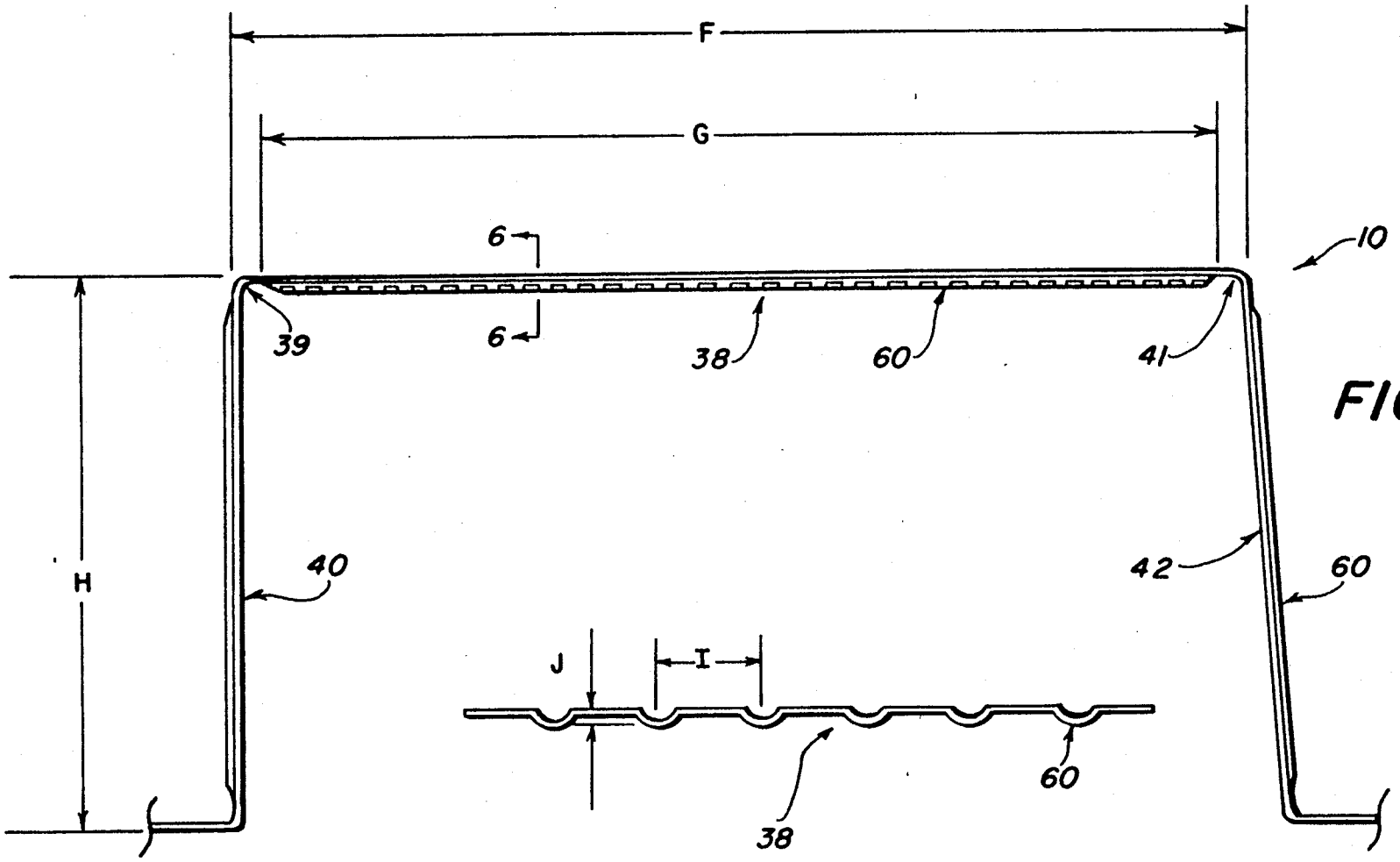
FIG. 5 is a schematic representation of a specific embodiment of the panel sections of the decking panel.
FIG. 6 is a schematic representation of the cross section 6—6 shown in FIG. 5.

In a preferred embodiment, and as shown in FIGS. 5 and 6, the first edge 39 and the second edge 41 of the first and second panel section 12, 28 are disposed at least 9 inches apart. The top flange member 38 has an essentially flat unbroken soffit except for a series of stiffening ribs 60 running transverse to the first and second edge 39, 41 which provide rigidity to the flange member 38 along its length during operation. Preferably, the stiffening ribs 60 are pressed rounded embossments having a depth of approximately ⅛ inch and are spaced approximately 1½ inches apart. Preferably, the webs 40, 42 also includes stiffening ribs 60 for increasing their rigidity.

The following are dimensions of one embodiment of the decking panel 10 as represented by the reference characters in FIGS. 5 and 6.

F: 14½ in.
G: 13 11/16 in.
H: 7½ in.
I: 1½ in.
J: 3/16 in.

While the reference characters represent but one embodiment, the decking panel 10 is not limited thereto, for instance, H could be 3½, 4½ or 6 inches.

In the operation of the invention, a plurality of I-beam girders 102 or steel trusses are provided set apart a distance 20 to 60 feet. The decking system 100 is utilized for spanning the open spaces between the girders 102 so that a structural roofing surface is provided, though the decking system 100 can be used equally well as a floor deck unit. In this example, it will be assumed that the open space to be spanned is 180" wide. In order to construct the support surface, a first decking panel 10 having a width of 18" and a length of 50' is disposed at one end of the open space on the girders 102. The decking panel 10 has a total depth of 15 inches; 7.5 inches which is provided by the first panel section 12 and 7.5 inches which is provided by the second panel section 28. Next, a second decking panel 10 is placed adjacent to the first panel 10 on the girders 102 such that the tab 44 of the first decking panel engages along its length with the notch 46 of the second decking panel. Additional decking panels 10 are joined side-by-side in this manner until the entire open space is spanned. Since, in this example, the open space to be spanned is 180" wide, ten 18" wide decking panels are needed. The first panel sections 12 of the decking panels 104 are subsequently secured to the girders with screws or welds. The first panel sections extend above the support surfaces of the girder 7.5 inches while the second panel sections extend below the support surfaces of the girders 7.5 inches. This is accomplished by assembling a first panel section 12 that is 4 to 24 inches longer than the second panel section 28. Since only the first panel section 12 protrudes over the structural support, the decking panel 10 can be attached to the beam or truss easily without the extra time required of cutting a hole in the first panel section 12. If both the first and second panel sections 12, 28 rested on the beam, the first panel section 12 would have to have a hole cut into it to gain access to attach the second panel section 28 which would be resting on the beam or truss. To finish the roof, insulation 108 is first laid on top of the first panel sections 12 and then exposed roofing material 110 is disposed on top of the insulation 108. Alternatively, concrete could be poured onto sections 12 to form a concrete floor. The second panel sections 28 disposed between the girders 102 form a ceiling within the building. The perforations and fiberglass bat 48 allow the extending second panel sections 28 to act as a finished acoustical ceiling.

The greater spanning capabilities of the decking panels 10 allow structural designers to space apart the girders 102 at a greater distance than is known in the art of decking panels. Further, the shortened second panel section 28 allows them to extend below the support surfaces to keep the clearance height of the decking panel 10 above the support surface to an acceptable height.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A long-span decking panel comprising:

a first panel section having a first open channel, a first side flange integrally extending from a first edge of the first open channel and a second side flange integrally extending from a second edge of the first open channel, said first panel section having a first end for bearing against a first support surface and a second end for bearing against a second support surface, said first panel having a first length; and a second panel section having a second open channel, a first side flange integrally extending from a first edge of the second open channel, a second side flange integrally extending from a second edge of the second open channel, said first side flange and second side flange of the first panel section fixedly connected to the first side flange and the second side flange of the second panel section, respectively, such that the first and second open channels form a cell, said second panel having a second length, said second length shorter than the first length such that the second panel section extends below said first and second support surface when the first panel section is supported thereupon.

2. A panel as described in claim 1 wherein the combined depth of the first and second panel sections is at least 6 inches.

3. A panel as described in claim 2 wherein the length of the first panel section is at least 20 feet.

4. A panel as described in claim 3 wherein each open channel includes a top flange member having a first edge and a second edge extending the length of the top flange member, a first web member integrally joined with and extending obliquely from said first edge of the top flange member; and a second web member integrally joined with and extending obliquely from said second edge of the flange member.

5. A panel as described in claim 4 wherein the first side flange of the first panel section includes a tab extending therefrom and the second side flange of the first panel section includes a notch for engaging with a tab of an adjacently disposed first panel section.

6. A panel as described in claim 5 wherein the second open channel has perforations.

7. A panel as described in claim 6 including a fiberglass bat disposed within said cell.

8. A panel as described in claim 7 wherein the first and second panel sections are comprised of galvanized steel.

9. A panel as described in claim 8 wherein the first and second web members extend from the top flange member at an angle of approximately 87°.

10. A panel as described in claim 9 wherein the respective side flanges are welded together.

11. A panel as described in claim 9 including a plurality of fasteners for securing the side flanges together.

12. A decking system as described in claim 1 wherein the first edge and the second edge of each top flange member are disposed at least 9 inches apart, each top flange member has an essentially flat unbroken soffit except for a series of stiffening ribs running transverse to said first and second edges for providing sufficient rigidity to prevent buckling of the top flange member along its length during operation.

13. A decking system as described in claim 12 wherein the stiffening ribs are pressed rounded embossments having a depth of approximately ⅛ inch and are spaced approximately 1½ inches apart.

14. A decking system comprising:

at least two horizontally disposed structural elements spaced a predetermined distance apart; and at least one decking panel having a cell for spanning the distance between the structural elements, said decking panel having a first panel section and a second panel section which is shorter than the first panel section such that each end of the first panel section of said decking panel disposed upon one of said structural elements and said second panel section extends below the support surfaces when the first panel section is supported thereupon, said decking panel having a depth of at least 6 inches.

15. A decking system as described in claim 14 wherein said predetermined distance is at least 20 feet.

16. A decking system as described in claim 15 wherein the decking panel includes:

a first panel section having a first open channel, a first side flange integrally extending from a first edge of the first open channel and a second side flange integrally extending from a second edge of the first open channel, said first panel section having a first end for bearing against a first support surface and a second end for bearing against a second support surface, said first panel having a first length; and a second panel section having a second open channel, a first side flange integrally extending from a first edge of the second open channel, a second side flange integrally extending from a second edge of the second open channel, said first side flange and second side flange of the first panel section fixedly connected to the first side flange and the second side flange of the second panel section, respectively, such that the first and second open channels form a cell, said second panel having a second length, said second length shorter than the first length such that the second panel section extends below said first and second support surface when the first panel section is supported thereupon.

17. A decking system as described in claim 16 wherein each open channel includes a top flange member having a first edge and a second edge extending the length of the top flange member, a first web member integrally joined and extending obliquely from said first edge of the top flange member; and a second web member integrally joined and extending obliquely from said second edge of the flange member.

18. A decking system as described in claim 17 wherein the first side flange of the first panel section includes a tab extending therefrom and the second side flange of the first panel section includes a notch for engaging with a tab of an adjacently disposed first panel section.

19. A decking system as described in claim 18 wherein the second open channel has perforations and a fiberglass bat is disposed within said cell.

20. A decking system as described in claim 19 wherein the structural elements include I-beams or steel trusses.

21. A decking system as described in claim 20 including roofing material disposed on top of the decking panels, or concrete disposed on top of the decking panels to form a floor.

* * * * *